US010226114B2

(12) United States Patent
Iwagaki et al.

(10) Patent No.: US 10,226,114 B2
(45) Date of Patent: Mar. 12, 2019

(54) CUTTER FOR DOUBLE-EDGED EYELID-FORMING TAPE OR THREAD

(71) Applicant: Artsbrains Co. Ltd., Shibuya-ku, Tokyo (JP)

(72) Inventors: Naoko Iwagaki, Fujimino (JP); Masayuki Kamagata, Chiba (JP); Jirou Taniyama, Yokohama (JP)

(73) Assignee: artsbrains. co. Ltd., Shibuya-ku, Tokyo (JP)

( * ) Notice: Subject to any disclaimer, the term of this patent is extended or adjusted under 35 U.S.C. 154(b) by 592 days.

(21) Appl. No.: 14/408,211

(22) PCT Filed: May 21, 2013

(86) PCT No.: PCT/JP2013/063993
§ 371 (c)(1),
(2) Date: Dec. 15, 2014

(87) PCT Pub. No.: WO2013/190939
PCT Pub. Date: Dec. 27, 2013

(65) Prior Publication Data

US 2015/0113812 A1 Apr. 30, 2015

(30) Foreign Application Priority Data

Jun. 19, 2012 (JP) ..... 2012-137971
Oct. 1, 2012 (JP) ..... 2012-219489

(51) Int. Cl.
*A45D 44/00* (2006.01)
*A45D 44/22* (2006.01)
*B26B 27/00* (2006.01)

(52) U.S. Cl.
CPC ..... *A45D 44/00* (2013.01); *A45D 44/22* (2013.01); *B26B 27/00* (2013.01)

(58) Field of Classification Search
CPC ..... A45D 44/22; A45D 44/00; B26B 27/00
(Continued)

(56) References Cited

U.S. PATENT DOCUMENTS 296,492 A * 4/1884 Wheeler ..... B26B 27/00 30/294
555,778 A * 3/1896 Landrum ..... B26B 13/18 30/234
(Continued)

FOREIGN PATENT DOCUMENTS

JP S5985163 U 6/1984
JP 3277180 B1 2/2002
(Continued)

OTHER PUBLICATIONS

International Search Report for International Application No. PCT/JP2013/063993 dated Jun. 18, 2013.
(Continued)

*Primary Examiner* — Ghassem Alie
*Assistant Examiner* — Nhat Chieu Do
(74) *Attorney, Agent, or Firm* — Fitch Even Tabin & Flannery, LLP

(57) ABSTRACT

There is provided a cutter for a double-edged eyelid-forming tape or thread. After the tape or thread has been attached to an eyelid, the cutter can perform a cutting action on an extra portion of the tape or thread. A cut is formed in a metal plate to extend from its front end to an intermediate position. By bending a pair of cut pieces in opposite directions, a cutting part is formed on the first end side of a cutter piece. A holding part on the second end side of the cutter piece is embedded in a gripping piece and is secured. Each cut piece is formed with a curved surface on the first end side from the
(Continued)

terminating part of the cut through a bent front end to a bent width end. The cut piece is extended from the bent width end to a front end edge.

10 Claims, 9 Drawing Sheets

(58) Field of Classification Search
USPC ..... 30/226–262, 286–289, 131; D8/57; 81/417
See application file for complete search history.

(56) References Cited

U.S. PATENT DOCUMENTS 1,454,543 A * 5/1923 Jones ..... B26B 27/00 30/287
1,566,649 A * 12/1925 Carlson ..... B26B 13/28 30/257
1,621,798 A * 3/1927 McFarland ..... B23D 29/026 30/168
1,637,607 A * 8/1927 Eggers ..... B26B 19/24 30/234
1,832,495 A * 11/1931 Melbye ..... B26B 13/18 30/234
4,020,846 A * 5/1977 Stokes ..... A61B 17/30 294/99.2
4,527,332 A * 7/1985 Aoki ..... B26B 27/00 30/230
5,023,997 A * 6/1991 Salvi ..... B26B 17/006 30/175
5,740,611 A * 4/1998 Schloss ..... A45D 26/0066 294/99.2
5,937,626 A * 8/1999 Gorman ..... A01D 46/247 30/173
6,733,856 B2 5/2004 Nojiri
D503,323 S * 3/2005 Hasegawa ..... D8/57
6,944,914 B2 * 9/2005 Tillim ..... A61B 17/2909 16/421
2004/0134506 A1 7/2004 Nojiri

FOREIGN PATENT DOCUMENTS

JP 2009155048 7/2009
JP 2011188892 9/2011

OTHER PUBLICATIONS

European Search Report for European Application No. 13807397.8 dated Feb. 5, 2016 (7 pages).

* cited by examiner (a)

(b)

(a)

(b)

(c)

(d)

CUTTER FOR DOUBLE-EDGED EYELID-FORMING TAPE OR THREAD

CROSS-REFERENCE TO RELATED APPLICATION

This application is a U.S. national phase application of International Application No. PCT/JP2013/063993, filed May 21, 2013, designating the United States, which claims priority to Japanese Patent Application No. 2012-137971, filed Jun. 19, 2012, and Japanese Patent Application No. 2012-219489, filed Oct. 1, 2012, all of which are incorporated by reference herein in their entirety.

TECHNICAL FIELD

The present invention relates to a cutter that cuts an extra portion of an elongated tape-like or thread-like double-edged eyelid-forming tool attached to an eyelid.

BACKGROUND OF THE INVENTION

As a double-edged eyelid-forming tool attached to an eyelid to form an artificial double-edged eyelid, a double-edged eyelid-forming tool disclosed in, for example, PTL 1 is already known. This double-edged eyelid-forming tool is formed by applying a pressure-sensitive adhesive to an elongated tape-like member or thread-like member made of a synthetic resin that is extendable and has an elastic expansion and contraction property even after the synthesized resin has been extended.

As illustrated in FIGS. 12(*a*) to 12(*d*), when this double-edged eyelid-forming tool 50 is to be used, the thread-like member 51 is first extended by holding parts 52 and 52 at both ends of it with fingertips and stretching it, and the tape-like member or thread-like member 51 is pressed against a line, on an eyelid, on which a double-edged eyelid is to be formed while the tape-like member or thread-like member 51 is being stretched so that the tape-like member or thread-like member 51 is attached to the eyelid, after which the fingertips are released from the holding parts 52 and 52. Then, the tape-like member or thread-like member digs into the eyelid due to the elastic contractive force of the tape-like member or thread-like member. As a result, a fold of a double-edged eyelid is formed in the eyelid.

The tape-like member or thread-like member 51 needs to be extended longer than the fold of a double-edged eyelid that is actually to be formed so that a manipulation, as described above, to press the tape-like member or thread-like member 51 against the eyelid with the tape-like member or thread-like member 51 stretched is simplified. Accordingly, after a double-edged eyelid has been formed, the tape-like member or thread-like member 51 that has been extended to plastic areas does not return to the original length, so an end 51*a* on the same side as the outer corner of the eye and an end (not illustrated) on the same side as the inner corner of the eye become extra portions as illustrated in FIG. 12(*d*). Therefore, treatment is needed to cut the extra portions at positions indicated by x illustrated in the drawing (not illustrated on the same as the inner corner of the eye). Usually, cosmetic scissors are used in the cutting treatment.

Various measures are taken for these cosmetic scissors to assure safety, so the cosmetic scissors are extremely safe even if they are used for treatment to cut the extra portions described above. However, it is desired to develop a cutting tool that can make the cutting manipulation simpler under adequate safety conditions because the manipulation is performed near the eye while looking in a mirror.

BRIEF SUMMARY OF THE INVENTION

A technical problem in this invention is to provide a cutter for a double-edged eyelid-forming tape or thread; after a double-edged eyelid-forming tape or thread has been attached to an eyelid, the cutter can perform cutting treatment on an extra portion of the tape or thread with a simpler manipulation in an extremely safe manner.

To solve the above problem, this invention, which is a cutter used to cut an extra portion of a double-edged eyelid-forming tape or thread attached to an eyelid, is characterized in that: the cutter has a gripping piece gripped with a hand to manipulate the cutter and a metallic cutter piece formed by integrating a cutting part used to cut the tape or thread, the cutting part being disposed on a first end side, and a holding part held to the gripping piece in a fixed manner, the cutting piece being disposed on a second end side; the cutting part of the cutter piece is structured so that the cutting part has one cut formed from an edge of the front end side of a thin metal plate toward its bottom end side, the terminating part of the cut being an intermediate position of the thin metal plate, a first cut piece and a second cut piece, which are divided by the cut, are bent in mutually opposite plane directions of the thin metallic plate so that the inner edges of the first cut piece and second cut piece, the inner edges being formed by the cut, are mutually spread from the terminating part of the cut toward the first end side, and the tape or thread can be cut by mutually pressing the terminating part of the cut and the tape or thread; and the first cut piece and second cut piece respectively pass a first bent front end and a second bent front end, which form respective front ends on the first end side in respective bending directions, respectively pass a first bent width end and a second bent width end, at which a distance apart from a central surface of the thin metal plate is maximized, and further respectively extend toward the front end edges of the first cut piece and second cut piece.

According to a preferred embodiment of the cutter for a double-edged eyelid-forming tape or thread in this invention, as for the first cut piece and second cut piece, at least a portion from each bent front end toward the relevant bent width end is formed as a smoothly curved surface in an outwardly convex shape. The front end edge of each cut piece is disposed closer to the second end side than the terminating part of the cut. More preferably, the front end edge of each cut piece is embedded in the gripping piece.

It is desirable for the first cut piece and second cut piece to be symmetrically bent with respect to the central surface of the thin metal plate. It is also desirable for the holding part of the cutter piece to be embedded in the gripping piece.

In this invention, preferably, a clearance in a direction along the central surface between the inner edge of the first cut piece and the inner edge of the second cut piece is gradually widened from the position of the terminating part of the cut toward the first bent front end and second bent front end.

It is also desirable for the cutter piece to be attached to the gripping piece through an inclined neck part.

According to the cutter for a double-edged eyelid-forming tape or thread in this invention, the cut part of a cutter piece is formed by bending a first cut piece and a second cut piece, which are divided by a cut in a thin metal plate, in mutually opposite plane directions and mutually separating the inner edges of the first cut piece and second cut piece from the terminating part of the cut toward the first end side, so the tape or thread can be cut with an extremely simple manipulation by which the tape or thread is led to the terminating part of the cut while being guided by the first cut piece and second cut piece and the terminating part of the cut and the tape or thread are mutually pressed.

In addition, since the first cut piece and second cut piece respectively pass a first bent front end and a second bent front end, which form respective front ends on the first end side in respective bending directions, respectively pass a first bent width end and a second bent width end, at which a distance apart from a central surface of the thin metal plate is maximized, and further respectively extend toward the front end edges of the first cut piece and second cut piece, the front end edges of the first cut piece and second cut piece are neither disposed toward the first end side nor disposed closer to the outside than the first bent width end and second bent width end with respect to the central surface of the thin metal plate. Therefore, it is possible to prevent the front end edge of each cut piece from hitting against the skin, so the tape or thread can be cut in an extremely safe manner. In this case, if the front ends of the first cut piece and second cut piece are embedded in the gripping piece, these front end edges are not exposed to the outside, so more reliable safety is assured.

BRIEF DESCRIPTION OF THE DRAWINGS

FIG. 1(*a*) is a front view and FIG. 1(*b*) is a side view.

FIG. 2(*a*) is a front view, FIG. 2(*b*) is a side view, and FIG. 2(*c*) is a plan view.

FIG. 5(*a*) illustrates a first variation, FIG. 5(*b*) illustrates a second variation, FIG. 5(*c*) illustrates a third variation, and FIG. 5(*d*) illustrates a fourth variation.

FIG. 7(*a*) illustrates a first variation and FIG. 7(*b*) illustrates a second variation.

FIG. 12(*a*) illustrates a state in which the holding parts of the double-edged eyelid-forming tape are held by fingertips, FIG. 12(*b*) illustrates a state in which a tape-like member is stretched to extend it, FIG. 12(*c*) illustrates a state in which the tape member is pressed against an eyelid with the tape member stretched, and FIG. 12(*d*) illustrates a state in which as a result of the fingertips being released from the holding parts, the tape-like member is elastically contracted and digs into the eyelid, forming a double-edged eyelid.

DETAILED DESCRIPTION OF THE INVENTION

Embodiments of the cutter for a double-edged eyelid-forming tape or thread in this invention will be described in detail with reference to the drawings.

Figure 1:
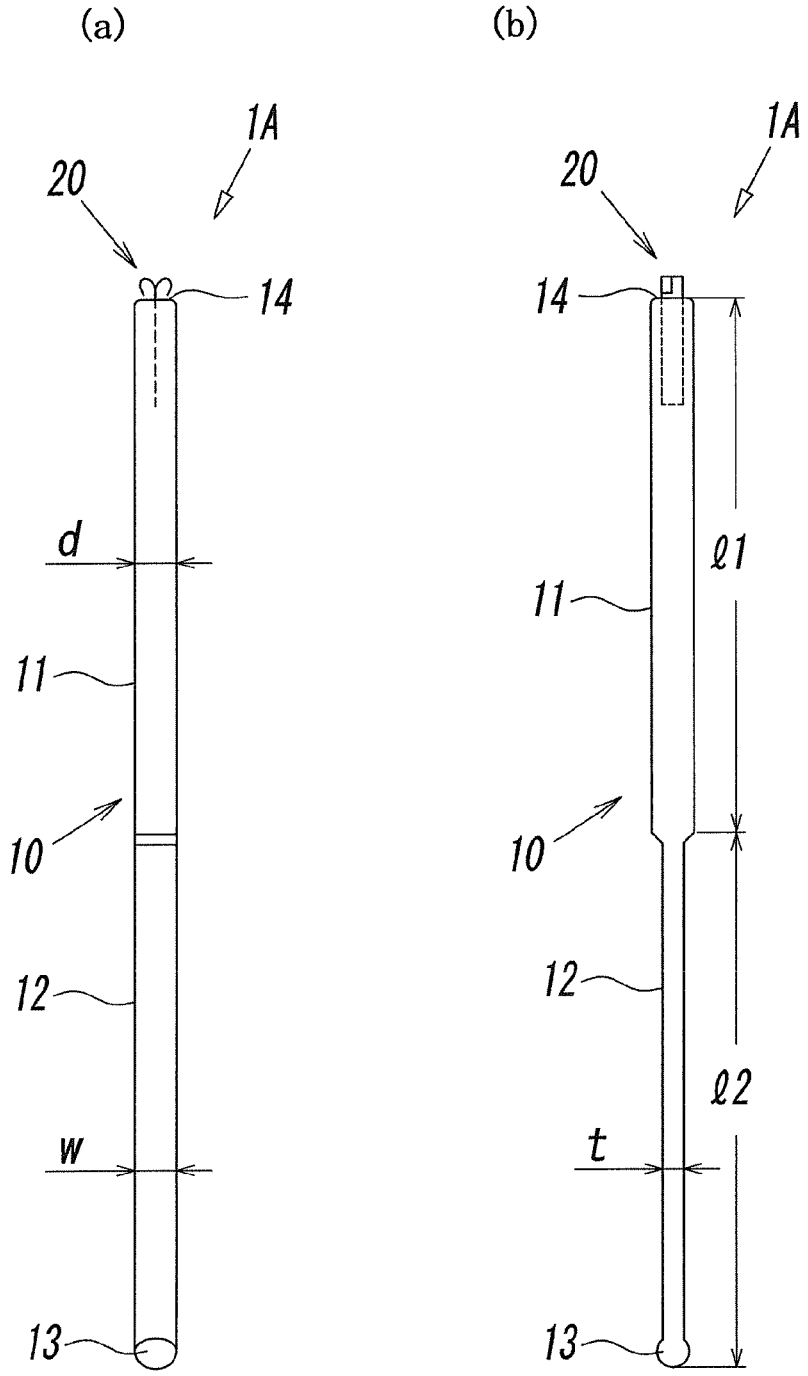
FIG. 1 is general views of a first embodiment of a cutter for a double-edged eyelid-forming tape or thread in this invention.

FIG. 1 illustrates a first embodiment of the cutter for a double-edged eyelid-forming tape or thread in this invention. A cutter 1A in this first embodiment is formed with a gripping piece 10 that is gripped by a hand and is used to manipulate the cutter and a metallic cutter piece 20 that is attached to the gripping piece 10 and is used to cut an extra portion of a double-edged eyelid-forming tape or thread attached to an eyelid.

The gripping piece 10 is integrally formed like a stick that is linear in the axial direction. Specifically, a portion on the front end side (upper side in FIG. 1) of the gripping piece 10 with respect to its central part is a gripping part 11 formed in a columnar shape with a diameter of d and a part on the bottom end side (lower side in FIG. 1) of the gripping part 11 is an extended part 12 formed in a flat plate shape with a width of w and a thickness of t. The cutter piece 20 is secured to an end on the front end side of the gripping piece 10 (that is, an end on the front end side of the gripping part 11). At the end, an end surface 14 of the gripping part 11 and its side surface are mutually linked through a smoothly curved surface. Thus, even if the gripping piece 10 hits against the skin during the manipulation of the cutter 1A, safety is assured.

Both surfaces of the extended part 12 are formed so as to be flat surfaces or concave surface dented at the center; the shape of the extended part 12 makes it hard for the cutter 1A to rotate around the axis when the gripping piece 10 is held with a hand. The end of the gripping piece 10 on the bottom end side (that is, the end of the extended part 12 on the bottom end side) is expanded in both plane directions; the end of the gripping piece 10 is an expanded part 13, the whole of which is formed with a curved surface. When a double-edged eyelid is to be formed by using a double-edged eyelid-forming tape or thread, this expanded part 13 is used to check a double-edged eyelid-forming line on the eyelid, that is, the position at which the tape or thread is to be attached. After a double-edged eyelid has been formed, the expanded part 13 is used to arrange the fold of the formed double-edged eyelid. When the gripping piece is held with a hand, the expanded part 13 also fulfils the role of preventing the cutter 1A from slipping in the axial direction.

It is desirable for the gripping piece 10 to be made of a synthetic resin such as polythene, but this is not a limitation. For example, the gripping piece 10 may be formed with a wood. In FIG. 1, the gripping piece 10 is linear in the axial direction and the width w of the extended part 12 is substantially the same as the diameter d of the gripping part 11 and the thickness t of the extended part 12 is substantially half the diameter d of the gripping part 11; of course, however, this is not a limitation. If the gripping piece 10 is easy to hold with a hand and can be used to easily manipulate the cutter 1A in a safe manner, the gripping piece 10 may have any form.

The specific dimensions of the gripping piece 10 in this embodiment should be appropriately set in consideration of various dimensions of the cutter piece 20, the easiness with which the gripping piece 10 is held, and the like. However, for example, the entire length of the gripping piece 10 can be set to about 100.0 mm and the length l1 of the gripping part 11 and the length l2 of the extended part 12 can be set to about 50.0 mm. It is desirable that the diameter d of the gripping part 11 be about 3 to 6 mm and the width w and thickness t of the extended part 12 be set according to the diameter d, but, for example, both the diameter d of the gripping part 11 and the width w of the extended part 12 can be set to 4 mm and the thickness t of the extended part 12 can be set to 2 mm. However, the gripping part 11 is not limited to these dimensions.

Figure 2:
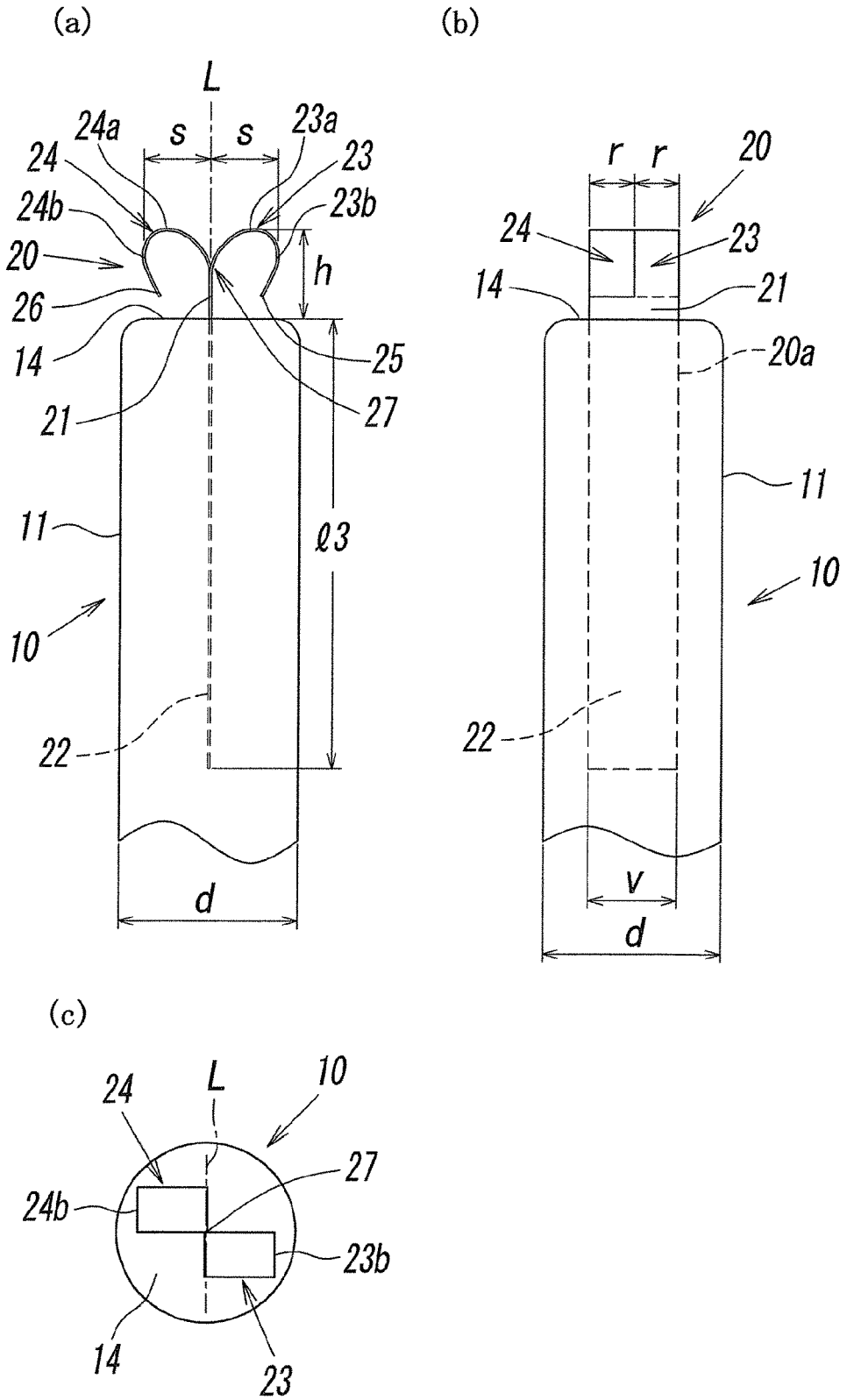
FIG. 2 is enlarged views of a cutter piece in the first embodiment.

The cutter piece 20 is formed with an elongated thin metal plate 20*a* with a width of v, as illustrated in FIG. 2. The cutter piece 20 is structured with a cutting part 21 that presses a double-edged eyelid-forming tape or thread and cuts it, the cutting part 21 being disposed on the front end side, that is, a first end side, and a holding part 22 by which the cutter piece 20 is held to the gripping piece 10 in a fixed manner, the holding part 22 being disposed on the bottom end side, that is, a second end side. The holding part 22 is embedded from the end surface 14 of the gripping piece 10 into the gripping piece 10 (specifically, into the gripping part 11). That is, the cutting part 21 of the cutter piece 20 is protruded from the end surface 14 of the gripping piece 10. In this case, it is desirable that the cutter piece 20 be firmly secured to the gripping piece 10 by forming a removal preventing part (not illustrated) on the holding part 22 of the cutter piece 20 by, for example, forming a convex part such as a cut and raised part and then engaging the removal preventing part and gripping piece 10 together.

Figure 3:
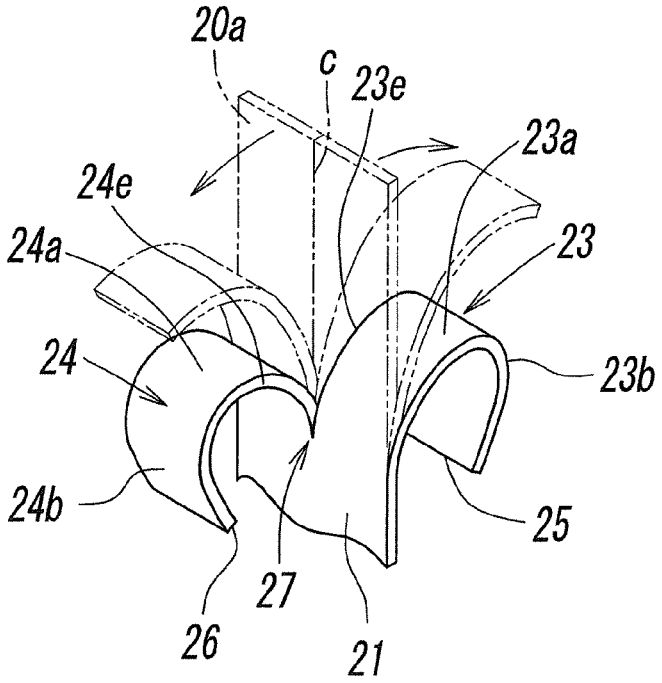
FIG. 3 is a schematic perspective view illustrating an example of a method of forming a cutting part of a cutter piece of the cutter for a double-edged eyelid-forming tape or thread in this invention.

The cutting part 21 of the cutter piece 20 is specifically formed as described below. As illustrated in FIG. 3, one linear cut c is first formed from an edge of the front end side of the thin metal plate 20*a*, which is part of the cutting part 21, toward its bottom end side, the terminating part 27 of the cut being an intermediate position of the thin metal plate 20*a* in the longitudinal direction. Next, a first cut piece 23, which is one piece divided by the cut c, and a second cut piece 24, which is the other, are bent in mutually opposite plane directions of the thin metal plate 20*a* from the terminating part 27 of the cut c. In this case, the terminating part 27 of the cut c is disposed at a position near the second end side of the cutting part 21, but the inner edges 23*e* and 24*e*, which are respectively formed by the cut c of the first cut piece 23 and second cut piece 24, are spread so as to form a substantially V shape along a curved surface forming a convex shape on the first end side in a front view, starting from the terminating part 27 of the cut c in directions in which the cut pieces 23 and 24 are bent, that is, directions orthogonal to a central surface L of the thin metal plate 20*a*, the central surface L extending through the terminating part 27 of the cut c toward the second end side.

The cut pieces 23 and 24 respectively pass a first bent front end 23*a* and a second bent front end 24*a*, which are their ends in a direction toward the first end side, respectively pass a first bent width end 23*b* and a second bent width end 24*b*, at which a distance apart from the central surface L of the thin metal plate (here, the central surface L of the cutting part 21) is maximized, and further respectively extend toward a first front end edge 25 and a second front end edge 26, which are respectively the end edges of the cut pieces 23 and 24 on their front end sides.

In each embodiment indicated here, series of parts of the cut pieces 23 and 24, from the position of the terminating part 27 of the cut c through the respective bent front ends 23*a* and 24*a* to the respective bent width ends 23*b* and 24*b*, are formed as a smoothly curved surface with a convex shape on the first end side (that is, an outwardly convex shape). The cut pieces 23 and 24 further extend from the respective bent width ends 23*b* and 24*b* toward the second end side. These first cut piece 23 and second cut piece 24 are symmetrically formed bilaterally with respect to the central surface L.

In the first embodiment of this invention illustrated in FIG. 2, the cut pieces 23 and 24 are further bent smoothly, from the respective bent width ends 23*b* and 24*b* toward the central surface L in an inner direction. As a result, the front end edge 25 of the cut piece 23 and the front end edge 26 of the cut piece 24 are respectively disposed more inside than the bent width ends 23*b* and 24*b* with respect to the central surface L in a range from the terminating part 27 of the cut c toward the second end side. The front end edges 25 and 26 are each oriented in an inclined direction toward the second end side and central surface L, and are each a free end separated from the end surface 14 of the gripping piece 10.

With the cutting part 21 formed in this way, when a double-edged eyelid-forming tape or thread is passed between the first cut piece 23 and the second cut piece 24, which are spread in a substantially V shape, so as to follow the central surface L and then the terminating part 27 of the cut c and the tape or thread are mutually pressed simply, the tape or thread can be extremely easily cut.

The dimensions of the cutter piece 20 in this embodiment can be set, for example, as follows: the width v of the thin metal plate is about 2 mm, and its thickness is about 0.01 to 0.5 mm, more preferably, about 0.15 mm; the entire length l3 of the holding part 22 embedded in the gripping piece 10 is about 10 to 20 mm, the width r of the first cut piece 23 and second cut piece 24 is about 1 mm, and a distance s from the central surface L of the thin metal plate to their bent width ends 23*b* and 24*b* is about 1.5 to 3.0 mm; and the protrusion height h of the cutting part 21 from the end surface 14 of the gripping piece 10 (here, a distance between the end surface 14 and the bent front end 23*a* and a distance between the end surface 14 and the bent front end 24*a*) is about 1.0 to 4.0 mm. In this case, it is desirable for a distance 2 s between the first bent width end 23*b* and the second bent width end 24*b* to be substantially the same as the diameter d of the gripping piece 10 or a little smaller than it. However, the cutter piece 20 is not limited to these dimensions or dimensional relationships.

As the thin metal plate 20*a* used to form the cutter piece 20, the use of a metal based on stainless steel, a copper alloy, or aluminum is desirable. Particularly, SUS301 CSP-EH stainless steel is preferably used. As metals based on a copper alloy, brass, copper, phosphor bronze, nickel silver, and beryllium copper are preferably used. Preferably used metals other than the above metals include iron-based metals such as SPCC and SK, nickel alloy-based metals, and titanium-based metals. However, the thin metal plate 20*a* is not limited to these metals.

Next, an example of a method of cutting an extra portion of a double-edged eyelid-forming tape T attached to an eyelid by using the cutter 1A will be more specifically described with reference to FIG. 4.

First, in a state in which an end of the double-edged eyelid-forming tape T attached to an eyelid is held with a finger tip of a hand, the cutting part 21 of the cutter 1A held with the other hand is brought close to a cutting position of the tape T from below it. At that time, when the cutter 1A is manipulated while any one of the bent width end 23*b* of the cut piece 23 and the bent width end 24*b* of the cut piece 24 is disposed on a side on which the bent width end faces the skin, the tape T is led to the terminating part 27 of the cut c while being guided by the first cut piece 23 and second cut piece 24, which is spread in a substantially V shape at the cutting part 21 of the cutter piece 20. Then, when the terminating part 27 of the cut c is simply pressed against the cutting position of the tape T, the tape T is cut and its extra part can be cut.

In this case, even if the cutting part 21 of the cutter piece 20 is brought into contact with the skin during a manipulation to cut the tape T, since the front end edge 25 of the cut piece 23 and the front end edge 26 of the cut piece 24 face the second end side, which is in a direction opposite to a direction toward the first end side, which is a manipulation direction, and the front end edges 25 and 26 do not extend more outwardly than the respective bent width ends 23*b* and 24*b* because the front end edges 25 and 26 are disposed more inside than the respective bent width ends 23*b* and 24*b*, it is possible to prevent the front end edges 25 and 26 from hitting directly to the skin.

The outer surface of the cut piece 23 from the bent front end 23*a* to the bent width end 23*b* and the outer surface of the cut piece 24 from the bent front end 24*a* to the bent width end 24*b*, these outer surfaces being likely to come into contact with the skin during a manipulation, are each formed as a smoothly curved surface with an outwardly convex shape, and the terminating part 27, equivalent to a cutting blade, of the cut c is not exposed at a position at which a contact with the skin occurs during a manipulation, so it is possible to assure extremely high safety.

As described above, according to the cutter 1A, it becomes possible to cut an extra portion of a double-edged eyelid-forming tape or thread attached to an eyelid with a simple manipulation in an extremely safe manner.

Figure 4:
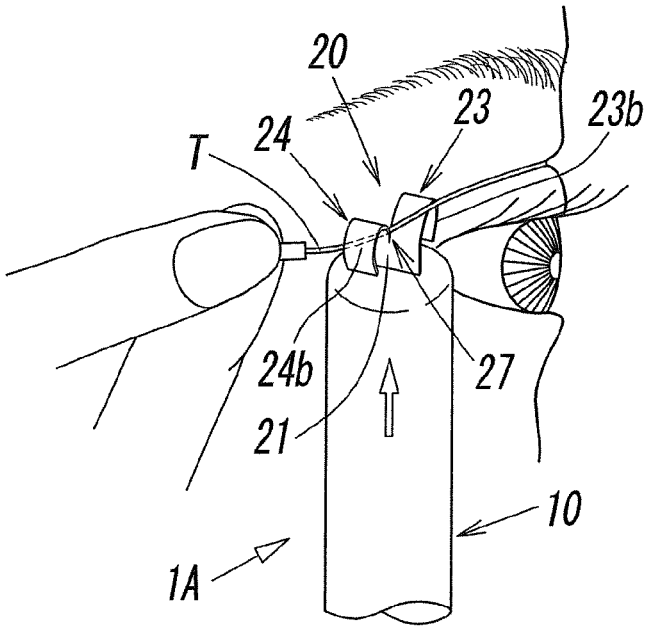
FIG. 4 is a schematic perspective view illustrating an example of a method of cutting an extra portion of a double-edged eyelid-forming tape attached to an eyelid by using the cutter for a double-edged eyelid-forming tape or thread in this invention.

Although, FIG. 4 illustrates the outer corner of the right eye, the cutting treatment can also be performed with a similar manipulation for the inner corner of the right eye and the outer corner and inner corner of the left eye. Although a form in which the cutter 1A is pressed against the tape T has been illustrated here, the tape T may be pressed against the cutter 1A.

Figure 5:
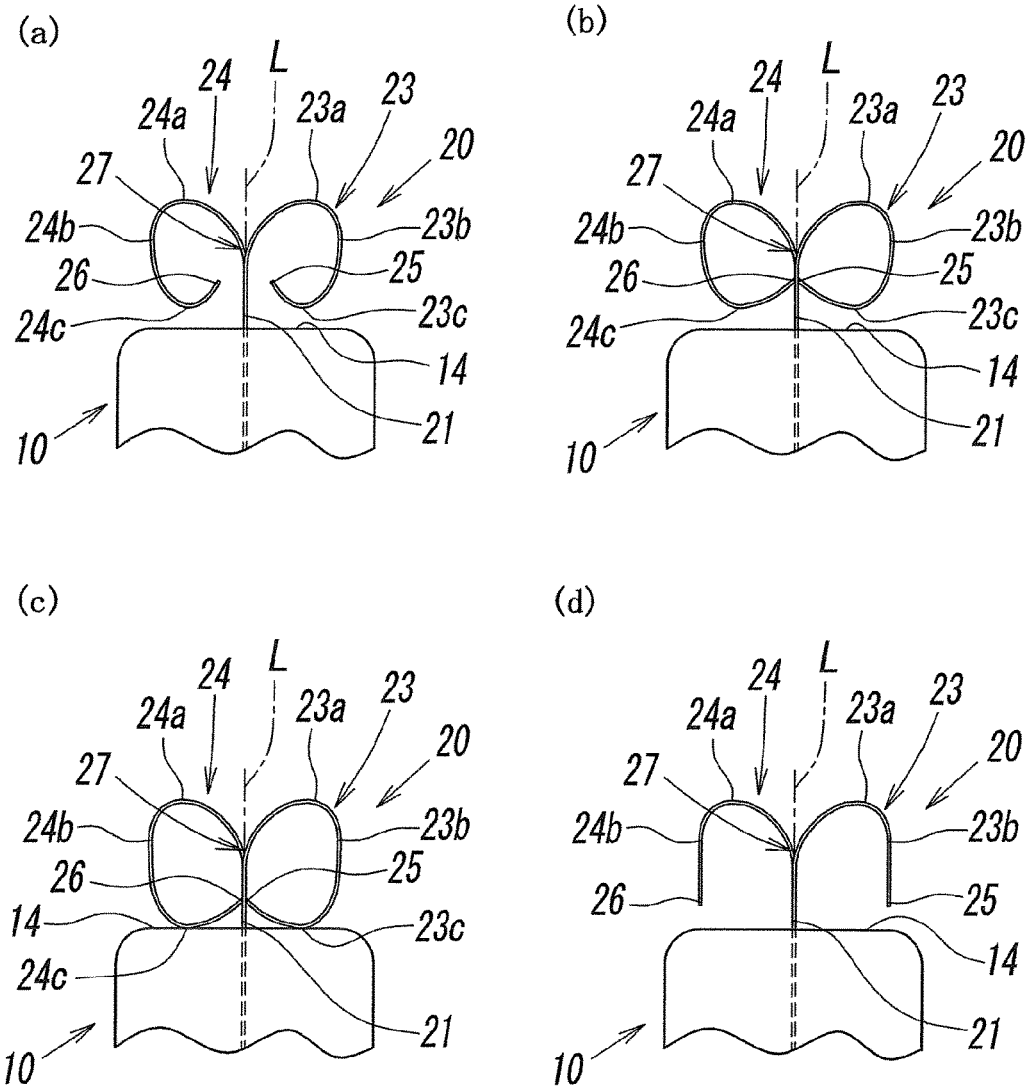
FIG. 5 is partially enlarged front views illustrating various variations of the first embodiment.

FIGS. 5(*a*) to 5(*b*) illustrate various modifications of the first embodiment of the cutter 1A for a double-edged eyelid-forming tape or thread, illustrated in FIG. 2, in this invention. To avoid duplicate explanations, only differences from the cutter 1A illustrated in FIG. 2 will be mainly described and descriptions of common parts will be omitted.

First, in a first variation in FIG. 5(*a*) to -a third variation in to FIG. 5(*c*), the first cut piece 23 and second cut piece 24, which extend from the terminating part 27 of the cut c to the second end side by sequentially passing through the first bent front end 23*a* and second bent front end 24*a* and the first bent width end 23*b* and second bent width end 24*b*, respectively, are smoothly curved inward toward the central surface L. Furthermore, the first cut piece 23 and second cut piece 24 respectively pass a first bending bottom end 23*c* and a second bending bottom end 24*c*, which are their respective bottom ends in a direction toward the second end side, and are smoothly curved again toward the first end side. As a result, the front end edge 25 of the cut piece 23 and the front end edge 26 of the cut piece 24 face in a direction inclined toward the first end side and the central surface L.

In this case, although the bending bottom end 23*c* of the cut piece 23 and the bending bottom end 24*c* of the cut piece 24 in the first and second embodiments are separated from the end surface 14 of the gripping piece 10, the bending bottom ends 23*c* and 24*c* in the third embodiment is in contact with the end surface 14. Although the front end edge 25 of the cut piece 23 and the front end edge 26 of the cut piece 24 in the first variation are each a free end, the front end edges 25 and 26 in the second and third variations are in contact with the respective surfaces of the thin metal plate at a position closer to the second end side than the terminating part 27 of the cut c of the cutting part 21. In the first embodiment and its variations, the front end edge 25 of the cut piece 23 and the front end edge 26 of the cut piece 24 are positioned closer to the second end side than the terminating part 27 of the cut c, but this is not a requisite.

In the fourth embodiment illustrated in FIG. 5(*d*), the first cut piece 23 and second cut piece 24, which respectively pass similarly through the first bent width end 23*b* and second bent width end 24*b* toward the second end side, simply extend toward the second end side while in substantially parallel to the central surface L. As a result, these front end edges 25 and 26 are respectively disposed at the same positions as the bent width ends 23*b* and 24*b* with respect to the central surface L in a range from the terminating part 27 of the cut c toward the second end side. That is, with the cut pieces 23 and 24, the distance apart from the central surface L is substantially the same between the bent width end 23*b* and the front end edge 25 and between the bent width end 24*b* and the front end edge 26. In this case, these front end edges 25 and 26 are each a free end separated from the end surface 14 of the gripping piece 10.

Even in a form as in this fourth embodiment, the front end edge 25 of the cut piece 23 and the front end edge 26 of the cut piece 24 face the second end side and do not respectively extend more outwardly than the bent width ends 23*b* and 24*b* with respect to the central surface L, so it is possible to prevent the front end edges 25 and 26 from hitting directly to the skin during a manipulation of the cutter 1A. In this case, however, it is desirable that the front end edges 25 and 26 be disposed close to the end surface 14 of the gripping piece 10 by making the diameter d of the gripping piece 10 a little larger than the distance 2 s between the bent width ends 23*b* and 24*b* as illustrated in the drawing.

Figure 6:
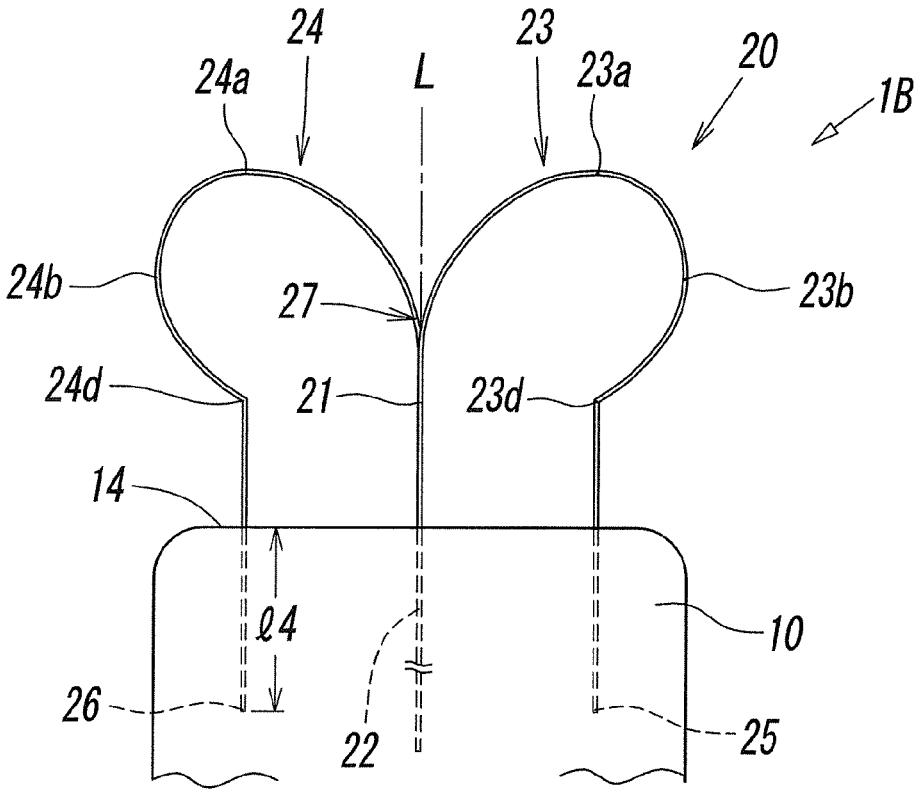
FIG. 6 is an enlarged front view of a cutter piece indicating a second embodiment of the cutter for a double-edged eyelid-forming tape or thread in this invention.
Figure 7:
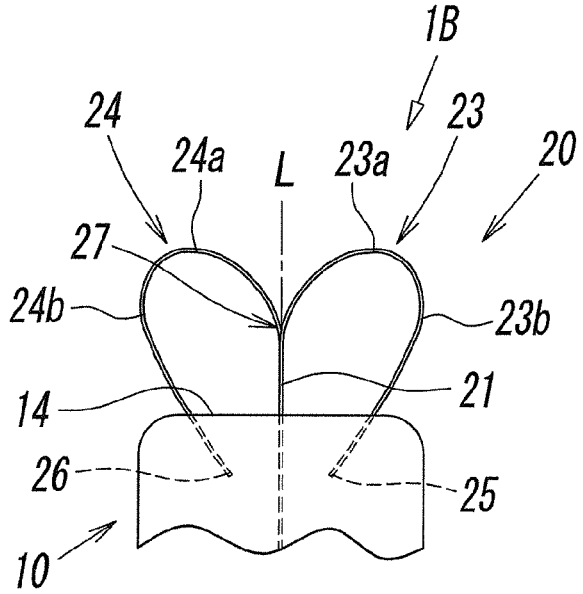
FIG. 7 is partially enlarged front views illustrating various variations of the second embodiment.
Figure 7:
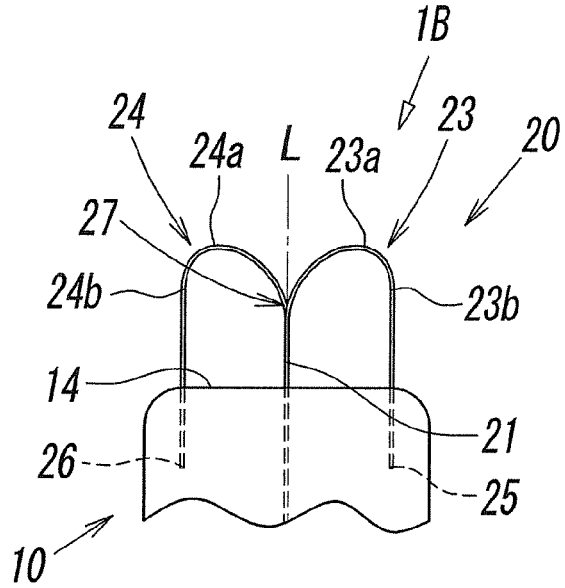

Next, FIGS. 6 and 7 illustrate a second embodiment of the cutter for a double-edged eyelid-forming tape or thread in this invention. As for a cutter 1B in this second embodiment, to avoid duplicate explanations, only differences from the cutter 1A in the first embodiment and its variations will be mainly described and descriptions of common parts will be omitted.

Main feature points of the cutter 1B in the second embodiment are that in the cutter 1A in the first embodiment, the front end edge 25 of the first cut piece 23 and the front end edge 26 of the second cut piece 24 are further embedded in the gripping piece 10. More specifically, as illustrated in FIG. 6, the first cut piece 23 and second cut piece 24, which respectively pass through the first bent width end 23*b* and second bent width end 24*b* and extend toward the second end side, are simply curved smoothly in an inner direction toward the central surface L and the inside. At intermediate points, the first cut piece 23 and second cut piece 24 are bent respectively at a first bent point 23*d* and a second bent point

24*d*, which are positioned closer to the second end side than the terminating part 27 of the cut c, toward the second end side. The cut pieces 23 and 24, which have been bent, are further extended toward the second end side while substantially in parallel to the central surface L. Front ends including their front end edges 25 and 26 are embedded from the end surface 14 of the gripping piece 10 into the gripping piece 10. In this case, the depth to which the front end edges 25 and 26 are inserted, that is, the distance 14 between the front end edges 25 and 26 embedded in the gripping piece 10 and the end surface 14 of the gripping piece 10, is desirably about 0.5 mm or more from the viewpoint of preventing the front end edges 25 and 26 from coming off.

When the front end edge 25 of the first cut piece 23 and the front end edge 26 of the second cut piece 24 are further embedded from the end surface 14 of the gripping piece 10 into the gripping piece 10 as described above, it becomes possible to prevent the front end edges 25 and 26 from being exposed. Since it is also possible to assure the strength of the cutting part 21, even if an unexpected external force is exerted on the cutting part 21, it is possible to reliably prevent the front end edge 25 of the cut piece 23 and the front end edge 26 of the cut piece 24 from protruding to portions that come into contact directly with the skin during a manipulation due to, for example, deformation of the cutting part 21. Therefore, higher safety can be assured.

FIGS. 7(*a*) and 7(*b*) respectively illustrate a first variation and a second variation of the cutter 1B in this second embodiment. In this first variation, the front end edge 25 of the first cut piece 23 and the front end edge 26 of the second cut piece 24 in the first embodiment illustrated in FIG. 2 are further extended simply and smoothly and are then embedded in the gripping piece 10 from its end surface 14 at an oblique angle. By contrast, in the second variation, the cut pieces 23 and 24 in the fourth variation, illustrated in FIG. 5(*d*), in the first embodiment are further extended simply while in parallel to the central surface L and are then similarly embedded in the gripping piece 10.

Figure 8:
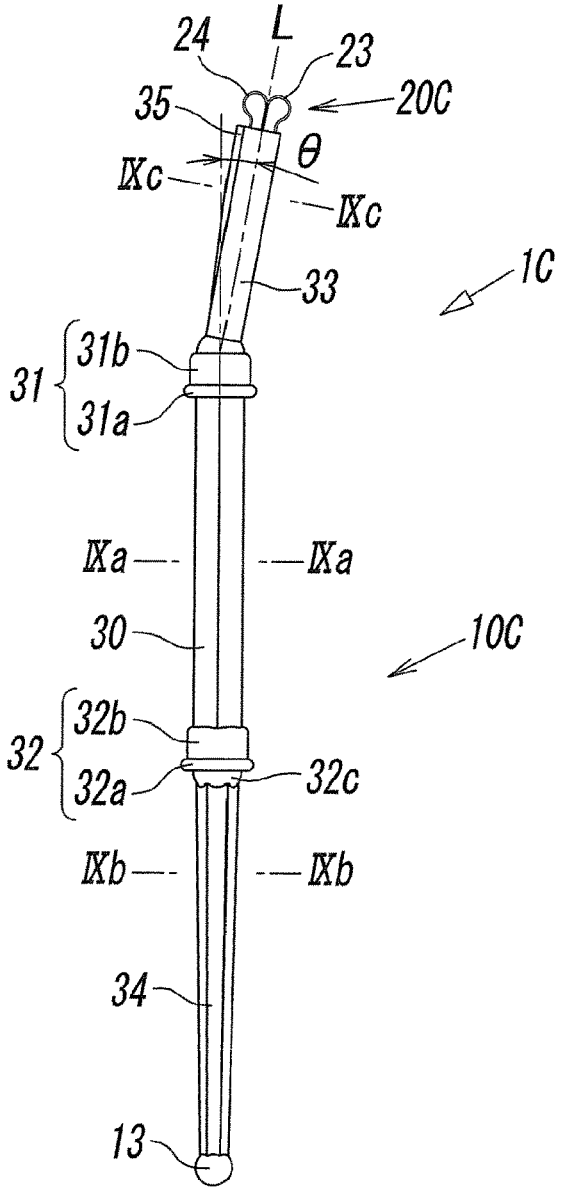
FIG. 8 is a front view of a third embodiment of the cutter for a double-edged eyelid-forming tape or thread in this invention.

FIG. 8 illustrates a third embodiment of the cutter in this invention. As for the cutter 1C in this third embodiment, the structures of a gripping piece 10C and a cutter piece 20C differ from the structures of the gripping piece 10 and cutter piece 20 of the cutter 1A in the first embodiment and the cutter 1B in the second embodiment. The structures of the gripping piece 10C and cutter piece 20C of the cutter 1C in this third embodiment will be described below in detail.

The gripping piece 10C has a gripping part 30 positioned at an intermediate point on the gripping piece 10C in its longitudinal direction, a neck part 33 linked to the front end of the gripping part 30 through a first slip-preventing part 31 in a state in which the neck part 33 is inclined in one direction, and an extended part 34 linearly linked to the bottom end of the gripping part 30 through a second slip-preventing part 32. A cutter piece 20C is attached to the front end of the neck part 33. The gripping part 30, neck part 33, extended part 34, and slip-preventing parts 31 and 32 of the gripping piece 10C are integrally formed with a hard or semi-hard material such as a synthetic resin.

Figure 9:
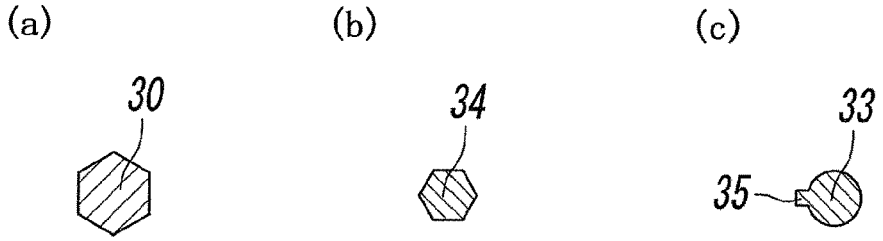
FIG. 9(*a*) is a cross-sectional view taken along IXa-IXa in FIG. 8, FIG. 9(*b*) is a cross-sectional view taken along IXb-IXb in FIG. 8, and FIG. 9(*c*) is a cross-sectional view taken along IXc-IXc in FIG. 8.

The gripping part 30 is a part that is held mainly with a thumb and an index finger, middle finger, or other finger. The cross section of the gripping part 30 is formed in an angular shape so that when the gripping part 30 is held with these fingers, the gripping part 30 is hard to rotate and the cutter piece 20C is accurately oriented to a necessary direction. In the example in the drawing, as illustrated in FIG. 9(*a*), the cross section of the gripping part 30 is formed in a regular hexagon shape. The cross-sectional shape and thickness of the gripping part 30 are constant over its whole length.

However, the cross-sectional shape of the gripping part 30 is not limited to a regular hexagon; the gripping part 30 can take any angular cross-sectional shape such as a regular square shape, a regular pentagonal shape, or other various polygonal shapes. When the gripping part 30 takes a regular hexagonal shape, a preferable face-to-face dimension, that is, an opposite side distance, is about 4 mm, but the dimension may be any other distance.

The first slip-preventing part 31 has a circular ring part 31*a* in a ring shape, the diameter of which is larger than the face-to-face dimension of the gripping part 30, and also has a short columnar part 31*b*, the diameter of which is smaller than the diameter of the circular ring part 31*a* but is larger than the face-to-face dimension of the gripping part 30. The short columnar part 31*b* is disposed closer to the neck part 33 than the circular ring part 31*a*. The neck part 33 is linked to the front end of the short columnar part 31*b*. The second slip-preventing part 32 has a circular ring part 32*a* and a short columnar 32*b* as with the first slip-preventing part 31. The short columnar 32*b* is disposed close to the gripping part 30 and the extended part 34 is linked to an end surface of the circular ring part 32*a* through a linking part 32*c*.

When the gripping part 30 is held with a hand and cuts an extra portion of a double-edged eyelid-forming tape or thread, the slip-preventing parts 31 and 32 stop any fingers at the circular rings 31*a* and 32*a* and the short columnar parts 31*b* and 32*b*, making it hard to slip the fingers in the axial direction. Thus, it becomes possible to reliably cut the extra portion of the tape or thread by pressing the cutter piece 20C against the tape or thread.

The extended part 34 is a part by which, mainly when a ring finger or little finger is placed on the extended part 34, the gripping piece 10C is stably gripped. As with the gripping part 30, the cross section of the extended part 34 is formed in an angular shape. The extended part 34 is formed so that it is tapered toward the front end side, that is, the free end side. At the front end, a partial spherical expanded part 13 is formed. In the illustrated example, the cross section of the extended part 34 is in a regular hexagonal shape as illustrated in FIG. 9(*b*), but the orientation of this hexagonal shape differs from the orientation of the hexagonal shape of the gripping part 30 through 90 degrees in a rotational direction around the central axis, as is clear from comparison between FIGS. 9(*a*) and 9(*b*). However, the orientations of the hexagonal shapes of the extended part 34 and gripping part 30 may be the same.

The neck part 33 has a shape in which an elongated protrusion 35 in a rib shape is provided on a side surface of a columnar so as to extend in the longitudinal direction of the columnar, as seen from FIG. 9(*c*). The elongated protrusion 35 is formed on a side surface of the neck part 33 on a side facing upwardly at an oblique angle. The height of the elongated protrusion 35 is largest on the front end side of the neck part 33 and is gradually reduced from at an intermediate point in the longitudinal direction of the elongated protrusion 35 toward the bottom end of the neck part 33.

The inclined angel θ of the neck part 33 with respect to the gripping part 30 is preferably 5 to 15 degrees, and more preferably about 10 degrees; however, the inclined angel θ may be any other angle.

Since the cutter piece 20C is attached to the gripping piece 10C through the inclined neck part 33 as described above, when a tape or thread is to be cut, the cutter piece 20C can be pressed against the tape or thread only by slightly inclining the gripping piece 10C without having to greatly inclining the entire gripping piece 10C, enabling a cutting manipulation to be performed easily.

The cutter piece 20C has basically the same structure as the cutter piece 20 provided as part of the cutter 1B in the second embodiment illustrated in FIGS. 6 and 7, but differs from the cutter piece 20 in the second embodiment in the shapes of the inner edge 23*e* of the first cut piece 23 and the inner edge 24*e* of the second cut piece 24.

Figure 10:
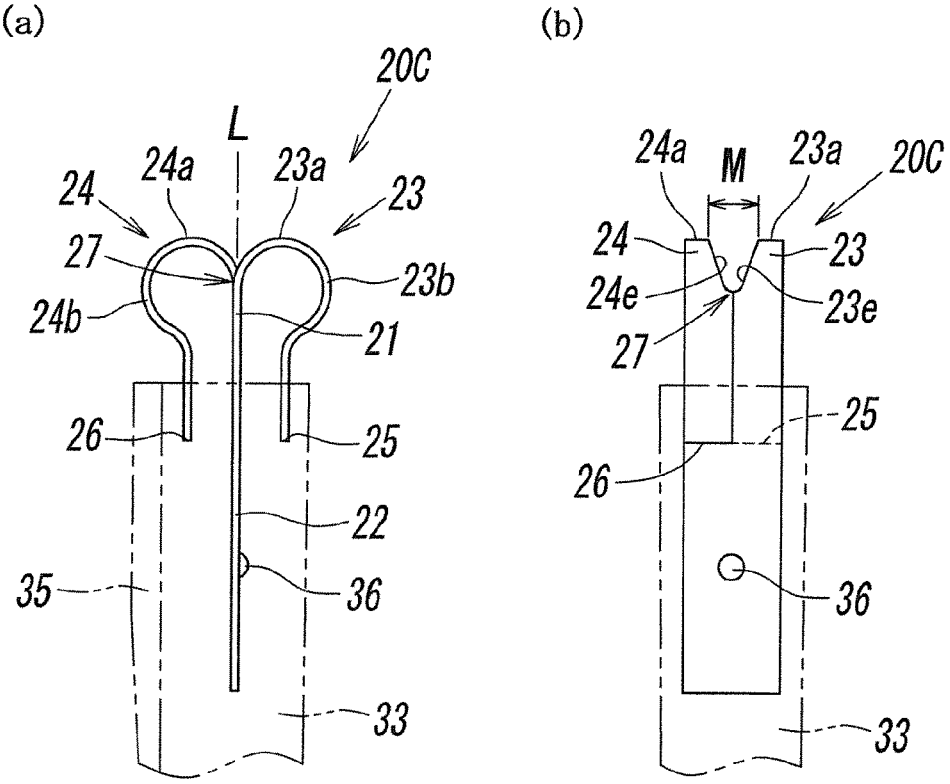
FIG. 10(*a*) is a front view of a cutter piece used as part of a cutter in a third embodiment, and FIG. 10(*b*) is a side view of the cutter piece.
Figure 11:
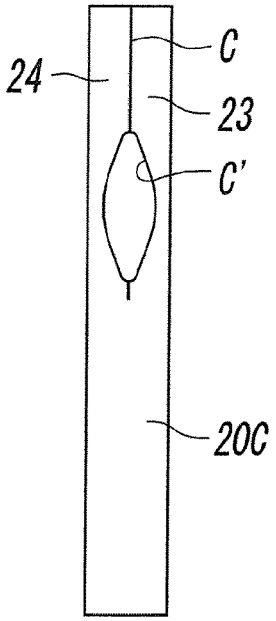
FIG. 11 is a plan view of a thin metal plate before the cutter piece in FIG. 10 is formed.
Figure 12:
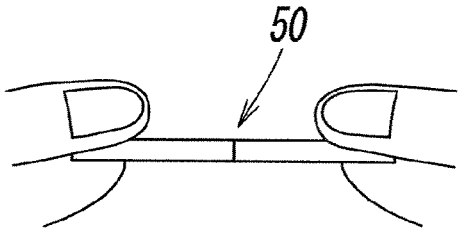
FIG. 12 is schematic views illustrating an example of a process to form a double-edged eyelid by using a double-edged eyelid-forming tape.
Figure 12:
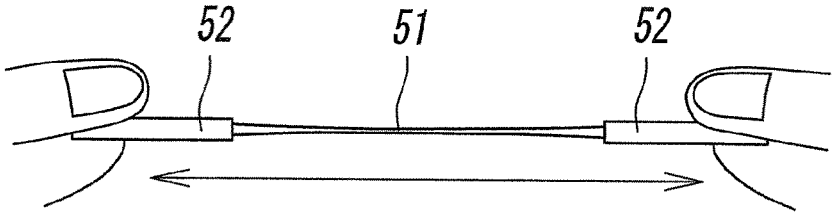
Figure 12:
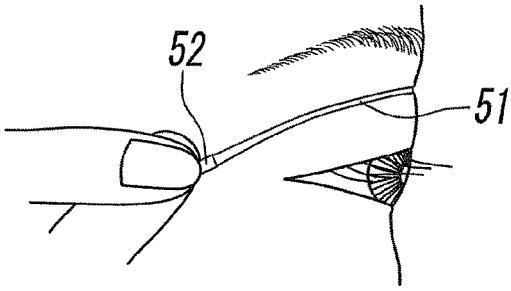
Figure 12:
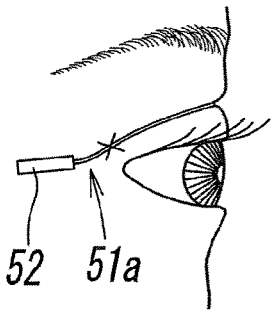

That is, the cutter piece 20C is formed by forming in a thin metal plate 20*a* used as a material, a cut c, which extends from one end of the thin metal plate 20*a* has a clearance expanded part c' having a rhombic shape or a shape like a rhombus with its corners rounded as part of the cut c, as illustrated in FIG. 11, and then bending the first cut piece 23 and second cut piece 24, which are divided by the cut c, in mutually opposite directions so that portions corresponding to places, at the center of the cut c' or near the center, at which the clearance is widest become the bent front end 23*a* of the first cut piece 23 and the bent front end 24*a* of the second cut piece 24, as illustrated in FIG. 10(*a*).

When the cutter piece 20C is formed as described above, the inner edge 23*e* of the first cut piece 23 and the inner edge 24*e* of the second cut piece 24, which are formed by the cut c, are placed in a state that is inclined so that a clearance M in a direction along the central surface L is gradually expanded from the position of the terminating part 27 of the cut c toward the first bent front end 23*a* of the first cut piece 23 and the second bent front end 24*a* of the second cut piece 24, as illustrated in FIG. 10(*b*). Therefore, when an extra portion of a double-edged eyelid-forming tape or thread is to be cut, the tape or thread is easily introduced between the first cut piece 23 and the second cut piece 24 and is also easily led to the position of the terminating part 27 of the cut c.

The cut c' may be in an elliptical shape, a rectangular shape, or another shape that extends in an elongated manner along the cut c or may be in a circular shape.

Alternatively, instead of forming the cut c' in part of the cut c, the entire cut c may be formed in a shape in which the clearance is gradually expanded from the position of the terminating part 27.

As seen from FIG. 8, the cutter piece 20C is attached to the front end of the neck part 33 so that the central surface L includes the central axis line of the neck part 33 in an orientation and in a direction in which the cutter piece 20C is inclined at the same angle as the neck part 33. In other words, the cutter piece 20C is attached so that one and the other of the first cut piece 23 and second cut piece 24 are positioned along the inclination of the neck part 33, the cut piece 23 (or 24) on one side is positioned on the same side as the side surface on which the elongated protrusion 35 is formed (side facing upwardly at an oblique angle), and the cut piece 24 (or 23) on the other side is positioned on a side opposite to that side (side facing downwardly at an oblique angle).

A protrusion 36 is formed on the holding part 22, which is embedded in the neck part 33 and is secured, of the cutter piece 20C by deforming part of the holding part 22 in its thickness direction by stamping or the like. When this protrusion 36 is engaged in the neck part 33, the protrusion 36 fulfills a removal preventing function. An end portion including the front end edge 25 of the first cut piece 23 and an end portion including the front end edge 26 of the second cut piece 24 are also embedded in the neck part 33 and are secured.

Structures of the cutter 1C in the third embodiment other than the structures described above as well as its usage method, preferred variations, and the like are essentially the same as in the cutter 1B in the second embodiment. Therefore, to avoid duplicate descriptions, main constituent parts of the cutter 1C in this third embodiment that are the same as with the cutter 1B in the second embodiment are assigned the same reference characters as with the cutter 1B in the second embodiment and the descriptions of these main constituent parts will be omitted.

So far, the cutter for a double-edged eyelid-forming tape or thread in this invention has been described, but it will be appreciated that this invention is not limited to the embodiments described above and their various variations; many design changes are possible without departing from the intended scope of the claims. For example, in the embodiments described above and their various variations, the first cut piece 23 and second cut piece 24 are symmetrically bent with respect to the central surface L of the cutting part 21 of the cutter piece 20 or 20C, but this is not a limitation; the first cut piece 23 and second cut piece 24 may be asymmetrically bent. In this case, of course it is possible to combine the forms of the cut pieces 23 and 24 and other forms in the embodiments described above and their various variations together.

To prevent the front end edge 25 of the cut piece 23 and the front end edge 26 of the cut piece 24 from coming off the gripping piece 10 or 10C in the second and third embodiments, it is also possible to provide a removal preventing part such as a convex part on the front ends of these front end edges. As for the cutter described above, the first cut piece 23 and second cut piece 24 are not necessarily bent smoothly throughout a portion from the terminating part 27 of the cut c to the bent width ends 23*b* and 24*b*. From the viewpoint of safety, however, it is desirable for the first cut piece 23 and second cut piece 24 to be smoothly bent so as to form an outward convex shape in at least portions from the bent front ends 23*a* and 24*a* to their respective bent width ends 23*b* and 24*b*, these portions being likely to come into contact with the skin during a cutting manipulation.

As for a method of bending the cut pieces 23 and 24 as well, various bending forms can be combined. For example, it is also possible to use a form in which the bent front ends 23*a* and 24*b* and the bent width ends 23*b* and 24*b* match and a form in which the front end edge 25 of the cut piece 23 and the front end edge 26 of the cut piece 24 are disposed closer to the first end side than the terminating part 27 of the cut c and the bent width ends 23*b* and 24*b*.

The invention claimed is:

1. A cutter for a double-edged eyelid-forming tape or thread used to cut an extra portion of a double-edged eyelid-forming tape or thread attached to an eyelid, the cutter comprising:

a gripping piece gripped with a hand to manipulate the cutter; and a metallic cutter piece formed by integrating a cutting part used to cut the tape or thread, the cutting part being disposed on a first end side, and a holding part held to the gripping piece in a fixed manner, the gripping piece being disposed on a second end side opposite the first end side; wherein the cutting part of the cutter piece is structured so that the cutting part has one cut formed from an edge of a front end side of a metal plate toward a bottom end side of the metal plate, a terminating part of the cut being an intermediate position of the metal plate, a first cut piece and a second cut piece, which are divided by the cut, are bent in mutually opposite plane directions of the metallic plate so that inner edges of the first cut piece and second cut piece, the inner edges being formed by the cut, are mutually spread from the terminating part of the cut toward a first end side, and the tape or thread is capable of being cut by mutually pressing the terminating part of the cut and the tape or thread, the first cut piece and second cut piece respectively pass a first bent front end and a second bent front end, which form respective front ends on the first end side with a convex shape on the first end side in respective bending directions, respectively pass a first bent width end and a second bent width end, at which a distance apart from a central surface of the metal plate is maximized, and further respectively extend toward front end edges of the first cut piece and second cut piece;

the gripping piece defines a longitudinal axis and the first and second cut pieces are each bent in opposite directions about a first bending axis and a second bending axis that are each perpendicular to the longitudinal axis;

the first bent front end of the first cut piece extends in a first direction away from the central surface and then extends in a second direction to define the first bent width end;

the second bent front end of the second cut piece extends in a direction away from the central surface that is opposite the first direction and then extends in the second direction, at least in part, to define the second bent width end;

the first and second cut pieces are fixed relative to one another such that a cutting operation is performed at the terminating part of the cut and without movement of the first and second cut pieces relative to one another, wherein the first cut piece is bent at least 180 degrees from the terminating part of the cut to the front end edge of the first cut piece to define a first curvilinear shape and the second cut piece is bent at least 180 degrees from the terminating part of the cut to the front end edge of the second cut piece to define a second curvilinear shape, wherein at least a portion of each of the first and second curvilinear shapes defines a substantially semicircle.

2. The cutter for a double-edged eyelid-forming tape or thread according to claim 1, wherein as for the first cut piece and second cut piece, at least a portion from each bent front end toward a corresponding bent width end is formed as a smoothly curved surface in an outwardly convex shape.

3. The cutter for a double-edged eyelid-forming tape or thread according to claim 1, wherein the front end edge of each cut piece is disposed closer to the second end side than the terminating part of the cut.

4. The cutter for a double-edged eyelid-forming tape or thread according to claim 3, wherein the front end edge of each cut piece is embedded in the gripping piece.

5. The cutter for a double-edged eyelid-forming tape or thread according to claim 1, wherein the first cut piece and second cut piece are symmetrically bent with respect to the central surface of the metal plate.

6. The cutter for a double-edged eyelid-forming tape or thread according to claim 1, wherein the holding part of the cutter piece is embedded in the gripping piece.

7. The cutter for a double-edged eyelid-forming tape or thread according to claim 1, wherein a clearance in a direction along the central surface between the inner edge of the first cut piece and the inner edge of the second cut piece is gradually widened from a position of the terminating part of the cut toward the first bent front end and the second bent front end.

8. The cutter for a double-edged eyelid-forming tape or thread according to claim 1, wherein the cutter piece is attached to the gripping piece through an inclined neck part.

9. The cutter according to claim 1, wherein each of the front end edges is located closer to the gripping portion than the terminating part of the cut is located relative to the gripping portion.

10. The cutter according to claim 1, wherein a line connecting the first bent front end and the second bent front end is perpendicular to the longitudinal direction.

* * * * *